United States Patent [19]

Beyl, Jr.

[11] 4,204,200

[45] May 20, 1980

[54] ELECTRONIC HORN ARRANGEMENT

[75] Inventor: Earl L. Beyl, Jr., Louisville, Ky.

[73] Assignee: Traintronics, Inc., Goshen, Ky.

[21] Appl. No.: 950,275

[22] Filed: Oct. 11, 1978

[51] Int. Cl.[2] ..... G08B 3/00

[52] U.S. Cl. ..... 340/384 E; 340/384 R

[58] Field of Search ..... 340/384 R

[56] References Cited

U.S. PATENT DOCUMENTS

| | | | |
|---|---|---|---|
| 3,882,275 | 5/1975 | Carrol | 340/384 E |
| 3,893,106 | 7/1975 | Schulein | 340/384 E |
| 3,995,492 | 12/1976 | Clynes | 340/384 E |
| 4,012,702 | 3/1977 | Weber | 340/384 E |
| 4,086,589 | 4/1978 | Cieslak | 340/384 E |

*Primary Examiner*—Harold I. Pitts

*Attorney, Agent, or Firm*—Edward M. Steutermann

[57] ABSTRACT

The present invention provides a broad spectrum frequency variable horn arrangement which includes a power supply means, at least two electronic signal generating means driven by said power supply means, with each signal generating means adapted to provide square wave pulsed voltage output of selected amplitude and different frequency periods. Mixing means are provided to additively mix the instantaneous output of each of the signal generating means and means to supply the mixed signal to an audible sound generator means where the amplitude and frequency of the generated audible sound corresponds to the signal received by the mixing means.

4 Claims, 5 Drawing Figures

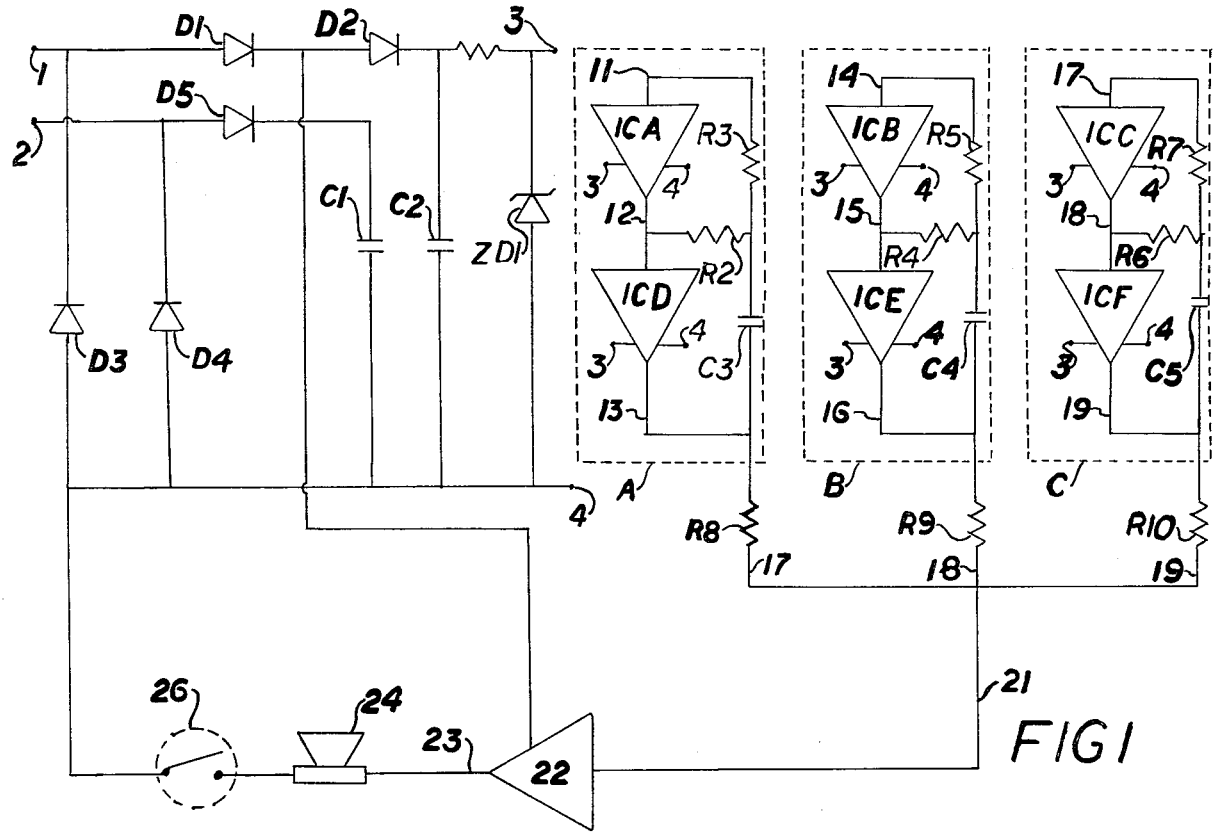
FIG 1
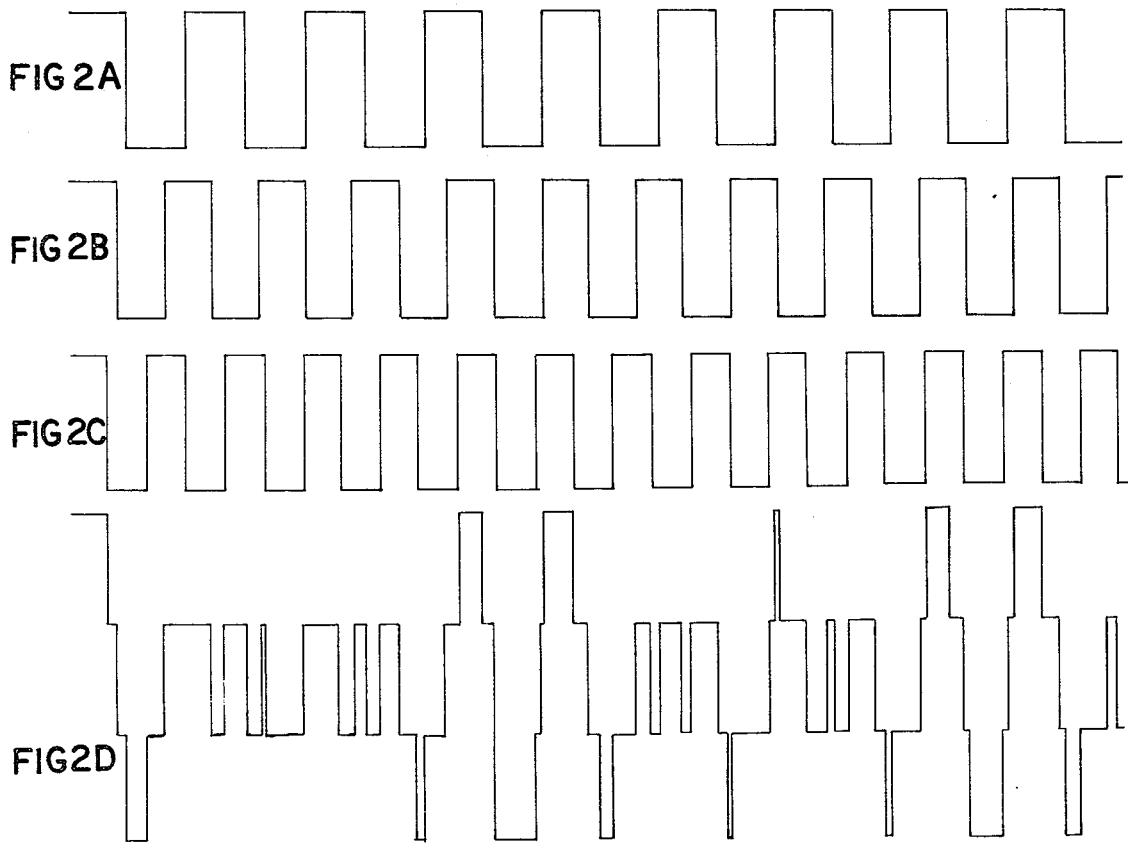

ELECTRONIC HORN ARRANGEMENT

BACKGROUND OF THE INVENTION

The present invention relates to an arrangement providing at least two signal generating devices to generate characteristic voltage output signals of different frequency from each generator and of selected voltage where the combined signal of the generators is supplied to an audible sound generating device, for example, an electromagnetic horn.

Devices in accordance with the present invention have a wide range of application, but have been found to be particularly useful as source generating means for an extremely realistic sound emulating the sound of a railroad diesel horn.

Heretofore, model train horns have been driven by single frequency power supplies. While prior art devices have been developed where attempts have been made to simulate the sounds of the air horns utilized currently by most diesel-driven railroad engines, such attempts have generally not been successful.

Additionally, the most successful attempts have resulted in devices which are expensive and therefore unattractive to all but the most avid model railroad follower.

The most commonly available model railroad horn operates in response to a power supply which generates a signal at a generally uniform frequency close to the average frequency of the air horns utilized in connection with diesel railroad engines. Moreover, such devices have been bulky and offensive when utilized in many model railroad layouts which must, in some instances, by mounted beneath the layout, or otherwise disguised, where the sound emanating from the device is muffled.

In general, since the demise of the steam railroad engine and its replacement by the diesel railroad engine, most diesel railroad engines are provided with three horns each operating at a different characteristic frequency so that the apparent instantaneous overall output intensity and frequency is the sum of the instantaneous output of the three horns and the time variation in frequency and intensity of the overall output is likewise dependent on the frequency of the three horns.

In many cases, individual railroads select a combination of horns operating at selected characteristic frequencies so that in some instances the overall apparent sound of a horn package is characteristic of a particular railroad. However, the variation from package to package is not great and at the present time, the overall sound of the horn package utilized by all railroads for their diesel-powered engines is substantially the same.

In current practice, railroad diesel engine horns are airpowered, and, usually, three horns (each operating at a different frequency) are provided to, in the aggregate, provide an output sound where the frequency pattern is non-repetitive or, if repetitive, repeated only infrequently. For example, in one application, the frequency of the three horns is 311 cycles per second, 370 cycles per second, and 470 cycles per second.

In most previous devices providing an electronically driven horn the horn operates at a single frequency at a regularly recurring frequency pattern and is used in an attempt to emulate the sound generated by most railroad engine diesel horns.

Insofar as known, there is no available device to provide an infinitely frequency variable signal generating arrangement to provide the characteristic sound of railroad engine diesel horn. Moreover, there is, insofar as known, no straightforward, inexpensive arrangement available to provide a signal to drive an electromagnetic horn device to reproduce the sound of a diesel horn from a low-voltage power supply where the device is suitable for use in connection with model railroads.

SUMMARY OF THE INVENTION

The present invention provides an electronic signal generating means, as hereinbefore described, to generate a generally infinitely variable frequency signal to drive a sound generating device, for example, an electromagnetic horn, to provide a sound which emulates the sound of a diesel horn.

Moreover, devices in accordance with the present invention can be adapted to be driven by a low voltage power source, AC or DC, where the device is easily adapted for use in connection with the operation of model railroads to provide a realistic effect to the railroad.

Likewise, devices in accordance with the present invention can be adapted for amplification so that the signals generated by the device could be utilized to power a larger horn which could be used in other applications, for example as a replacement for the horns presently used in the operation of railroad diesel locomotives.

In such an application, the devices provided by the present invention would be advantageous in that it would be possible to eliminate the three horns presently commonly used in the operation of railroad diesel locomotives.

In addition, devices in accordance with the present invention provide arrangements where the frequency pattern of the sound emitted from the sound generating device can be easily modified so that when it is desirable to vary the characteristics of the frequency pattern of the sound output, adjustments can be made to accomplish such an objective.

In this regard, devices in accordance with the present invention can be adapted to emulate the sounds produced by any number of air horns operating in unison and devices in accordance with the present invention could be utilized in replacement of air horns or other sound devices commonly utilized in other applications.

Briefly, the present invention provides a method and apparatus for generating an infinitely variable frequency sound including a power supply, at least two signal generating means each providing a cyclical signal of selected maximum voltage and frequency where the frequency of each of the signal generating means is different, means to aggregate the signal output from each of the signal generating means into a common output signal, means to supply the common output signal to a sound generating device which provides a characteristic sound pattern emulating the frequency of the input to the sound generating device.

One example in accordance with the present invention is discussed hereinafter and it will be recognized that the following description is not by way of limitation and that various other arrangements within the scope of the present invention will occur to those skilled in the art upon reading the disclosure.

BRIEF DESCRIPTION OF THE DRAWINGS

Referring now to the drawings which illustrate one arrangement within the scope of the present invention:

FIG. 1 is a schematic illustration of one circuit within the scope of the present invention;

FIGS. 2A–2D illustrates typical output frequencies of the arrangement shown in FIG. 1 and the summation thereof.

Referring now to FIG. 1 which shows a schematic illustration of one example of an arrangement within the scope of the present invention a current supply terminals 1–2 can be provided and connected to a source of alternating or direct current. For arrangements where alternating current is provided terminals 1, 2 are connected to a full wave bridge consisting of diodes D1–D4 the source may be either alternating or direct current with no need to observe polarity. The direct current output of the bridge is filtered by filters C1 and C2 as well as diode D5 where a resistor R1 is provided as a dropping resistor to limit the Zener current in voltage regulator Zener diode ZD1 which limits the main supply voltage at terminal 3 which is supplied to the oscillator circuits described hereinafter.

The voltage at terminal 3 can, for example, be in the range of 10 volts direct current depending upon the input voltage at terminals 1,2.

In accordance with one feature of the present invention multiple oscillator circuits A, B and C are provided in the example shown in the figures.

It is to be understood that any number of oscillator circuits in excess of one can be provided within the scope of the present invention and the number of oscillator circuits and the frequency of oscillation determine the characteristics of the sound emitted from the arrangement.

The oscillators shown in the example of FIG. 1 can be astable multi-vibrators using two CMOS inverters per oscillator. Referring to circuit A which is typical of the other oscillator circuits B and C, invertors ICA and ICD are connected in series where the main supply voltage is provided from terminal 3 while the source supply voltage is supplied from terminal 4, which is connected as shown from terminal 1 of the power supply.

A resistor R3 and capacitor C3 are provided in series in the circuit with inverters ICA and ICD while the resistor R2 is provided in parallel between R3 and the output of inverter of IC1 where resistor R2 and capacitor C3 set the time constant and thus the frequency of the oscillator circuit A. Resistor 3 is a high value compensating resistor which makes the oscillating frequency at output 7 insensitive to variations in supply voltage. Similar output frequencies are provided at outputs 8 and 9.

Any number of oscillators of the type shown in circuits A, B and C can be connected from an oscillator circuit input 11 described hereinafter.

With respect to oscillator circuit A, principally, two integrated circuits providing a, for example, hex inverter buffer for example manufactured by Radio Corporation of America (TM) part numbers CD4049 AE can be provided in series with the output 12 of ICA connected to the input 14 of inverter ICD where the output 15 of inverter ICD is connected to one side of capacitor C3 while the input 11 to inverter ICA is connected through a resistor R3 to the other side of capacitor C3. A resistor R2 is shown and connected from the output of inverter ICA in parallel between resistor R3 and capacitor C3.

The output of the circuit 7, provides a signal of a discrete frequency dependent on the relative values of resistor R2 and capacitor C3.

Oscillator circuits B and C are of a similar configuration where the referenced parts in circuit A are shown in the following table with respect to the corresponding parts in circuits B and C.

| Circuit A | Circuit B | Circuit C |
|---|---|---|
| ICA | ICC | ICE |
| Terminal 11 | Terminal 5 | Terminal 9 |
| Terminal 12 | Terminal 4 | Terminal 10 |
| R2 | R4 | R6 |
| R3 | R5 | R7 |
| ICB | ICD | ICF |
| Terminal 14 | Terminal 3 | Terminal 7 |
| R3 | R5 | R7 |
| C3 | C4 | C5 |
| Output 17 | Output 18 | Output 19 |

In the example shown, resistors R2-C3, R4-C4, and R6-C5, can be provided where circuit A is a low frequency oscillator, circuit B is a mid-range oscillator and circuit C is a high-range oscillator. For example, the oscillation rates of the three circuits can, characteristically be circuit A 311 cycles per second, circuit B 370 cycles per second, and circuit C 470 cycles per second. The output signals from each of the oscillators is supplied to the output leads 17–19 respectively to a signal mixing buss 21 where the oscillating outputs 17–19 are mixed and supplied to a signal amplifier 22 having an output 23 through a resistor R4 to a speaker 24 to convert the signals to sound to be emitted from a speaker. A switch 26 can be provided in series between speaker 24 and terminal 1.

The outputs from each of the oscillating circuits A–C is a regular output. FIG. 2B represents the output of oscillator B and FIG. 2C represents the output from oscillator C. FIG. 2D is the instantaneous sum of the outputs from oscillator circuits A–C representing the signal generated at buss 21 and supplied to amplifier 22 which is converted to the audible sound emitted from speaker 24.

In accordance with one feature of the present invention a nonrepetitive output can be provided by selecting the frequency of the output signal of the three circuits A, B, and C such that no integer is evenly divisible into all three selected frequencies.

Having fully described one arrangement in accordance with the present invention, it will be recognized that various other arrangements within the scope of the present invention will occur to those skilled in the art upon reading the disclosure set forth herein.

I claim:

1. The invention claimed is a broad spectrum frequency varying horn arrangement which includes direct current power supply means, at least two wave signal generating oscillating circuit means adapted to provide square wave pulsed voltage output of selected amplitude and different fixed frequency, mixing means to additively mix the instantaneous output signals of each signal generating ocillator means to provide a stepwise varying output signal and amplifier means to receive the mixed signals of the oscillator circuit means, amplify said signal and transmit said signal to an audible sound generator means.

2. The invention of claim 1 wherein each said oscillator circuit means each includes first and second signal inverter means each having an input and output, with the output of the first signal inverter means connected to the input of the second signal inverter means, the output of the second signal inverter means connected to said mixing means and where the input of said first signal inverter means is connected through capacitor menas to the output of said second signal inverter means where selected resistor means are provided from the output of said first signal inverter means to the capacitor means to determine the frequency of oscillation of said oscillator means.

3. The invention of claim 2 including 3 signal generating oscillator circuits wherein the output signal from each said oscillator circuit is a square wave pulsed signal of selected frequency different than the frequency of the other generators.

4. The invention of claim 3 wherein the frequency of each signal generator is selected such that no whole integer is evenly divisible into all three frequencies.

* * * * *